US006969956B1

(12) United States Patent
Chou et al.

(10) Patent No.: US 6,969,956 B1
(45) Date of Patent: Nov. 29, 2005

(54) CURRENT CONTROL APPARATUS FOR FLUORESCENT LAMPS

(75) Inventors: Chin-Wen Chou, Hsin-Tien (TW); Eddie Cheng, Hsin-Tien (TW); Chin-Biau Chung, Hsin-Tien (TW)

(73) Assignee: Zippy Technology Corp., Taipei Hsien (TW)

( * ) Notice: Subject to any disclaimer, the term of this patent is extended or adjusted under 35 U.S.C. 154(b) by 0 days.

(21) Appl. No.: 10/840,218

(22) Filed: May 7, 2004

(51) Int. Cl.[7] ..... G05F 1/00; H05B 37/02
(52) U.S. Cl. ..... 315/209 PZ; 315/291
(58) Field of Search ..... 315/55, 56, 57, 315/209 PZ, 291, DIG. 2

(56) References Cited

U.S. PATENT DOCUMENTS 4,873,471 A * 10/1989 Dean et al. ..... 315/308
6,016,052 A * 1/2000 Vaughn ..... 323/355
6,380,695 B1 * 4/2002 Lin et al. ..... 315/291
6,747,421 B2 * 6/2004 Kohn ..... 315/291

* cited by examiner

*Primary Examiner*—Don Wong
*Assistant Examiner*—Minh Dieu A
(74) *Attorney, Agent, or Firm*—Birch, Stewart, Kolasch & Birch, LLP

(57) ABSTRACT

A current control apparatus for fluorescent lamps adopted for use on high voltage actuated a fluorescent lamp includes a high frequency pulse modulator to provide voltage distribution signals, a power switch which is a MOSFET to output actuation signals, a conversion unit to receive the voltage distribution signals and perform voltage transformation, a piezoelectric transformer to receive the transformed voltage and perform voltage transformer, and the fluorescent lamp connecting to the piezoelectric transformer. The high frequency pulse modulator obtains a feedback current from the output ends of the fluorescent lamps through the signal processor to redistribute current and maintain evenness of the current in the fluorescent lamp.

7 Claims, 3 Drawing Sheets

CURRENT CONTROL APPARATUS FOR FLUORESCENT LAMPS

FIELD OF THE INVENTION

The present invention relates to a current control apparatus for fluorescent lamps and particularly to a current control apparatus that maintains even current in a fluorescent lamp through a current feedback control approach.

BACKGROUND OF THE INVENTION

At present the light source used by liquid crystal display (LCD) of desktop computers and notebook computers, PDA, and Webpad generally is a fluorescent lamp (such as cold cathode fluorescent lamp—CCFL) actuated by a high voltage. Light is projected to a backlight plate to enable users to see the displaying picture.

LCD TV or LCD display screen with a touch film requires a greater luminosity to compensate visual requirement. As the fluorescent lamp is driven by a high voltage, when the current is higher, the luminosity also is greater. Moreover, in order to increase the luminosity, a plurality of fluorescent lamps are often being used. In such an occasion, the most important issue is to maintain the evenness of lamp current among the loads or minimize the characteristic tolerance among them. Moreover, with increased number of the fluorescent lamps, the number of control units to actuate and ignite the lamps also increases. As a result, the size of the circuit board increases. Fabrication is more difficult and cost is higher. In the event that a plurality of fluorescent lamps are used to increase the luminosity and evenness, because of the tolerance of the fluorescent lamps, uneven tube current and luminosity often occur to the fluorescent lamps. It makes selection of the fluorescent lamps more difficult or results in more fluorescent lamps are needed to improve the luminosity and evenness. Hence the cost becomes even higher, and fabrication and adjustment are even more difficult. The conventional method for controlling the current of fluorescent lamps is generally as follow:

Refer to FIG. 1 for a conventional actuating device for driving and igniting fluorescent lamps. It includes a power supply 10, a high frequency pulse modulator 11, a power switch 12, a conversion unit 13, a piezoelectric transformer 14 and two fluorescent lamps 15 and 15'. The two fluorescent lamps 15 and 15 are jointly connected to a resistor 16 and are grounded. When a voltage is input, the power switch 12 actuates the piezoelectric transformer 14 through the conversion unit 13 to generate a high voltage output because of inverted/positive piezoelectric effect and actuate and ignite the fluorescent lamps 15 and 15'. Due to the piezoelectric transformer 14 generates a positive half cycle signal and a negative half cycle signal to actuate the fluorescent lamps 15 and 15' at the same time, and the fluorescent lamps 15 and 15' output a positive half cycle signal and a negative half cycle signal that cancel out each other by grounding, there is no voltage drop on the resistor 16 end. As a result, the output ends of the fluorescent lamps 15 and 15' also have no voltage drop. Hence it is not possible to feed back a voltage signal to the high frequency pulse modulator 11. Therefore it is not possible to control the current of the fluorescent lamps 15 and 15' through a voltage feedback circuit. Moreover, the conventional fluorescent lamps 15 and 15' also have other problems, such as unstable electrodes, gas, and the like. They will cause abnormal operation of the current in the fluorescent lamps 15 and 15' (such as power loss). The conventional technique previously discussed uses merely one feedback circuit to connect the high frequency pulse modulator 11, and cannot control the current in the fluorescent lamps 15 and 15'. This is because the fluorescent lamps 15 and 15' have to be ignited by a high voltage to generate a high energy current. It is easy to generate high frequency noise or arc effect. This phenomenon tends to result in power loss or damages of the fluorescent lamps 15 and 15'.

SUMMARY OF THE INVENTION

Therefore the primary object of the present invention is to resolve the aforesaid disadvantages. The invention provides a current control apparatus to maintain even current in fluorescent lamps through a current feedback approach.

The present invention also provides another approach that uses a signal processor to detect output current of the fluorescent lamps and output a current compensation signal to a high frequency pulse modulator to redistribute the current.

The current control apparatus according to the invention is adopted for use on high voltage actuated fluorescent lamps to maintain current evenness in the fluorescent lamps. It includes:

- a high frequency pulse modulator to provide voltage distribution signals and transmit a pulse width modulation (PWM) resonant frequency signal;
- a power switch to output an actuation signal;
- a conversion unit to receive the voltage distribution signal and transform voltage;
- a piezoelectric transformer to receive the transformed voltage and perform voltage transformation; and
- a fluorescent lamp connecting to the piezoelectric transformer and has an output end grounded.

The main features of the invention include: dividing the fluorescent lamp to a positive phase fluorescent lamp and an inverted phase fluorescent lamp; the positive phase fluorescent lamp and the inverted phase fluorescent lamp have respectively an output end to receive a current compensation signal to the high frequency pulse modulator; the fluorescent lamps are actuated by a positive half cycle and a negative half cycle actuation signals transferred from the conversion unit; the high frequency pulse modulator detects output current of the fluorescent lamps through a signal generator to output a resonant frequency to control current variation of the fluorescent lamps.

The foregoing, as well as additional objects, features and advantages of the invention will be more readily apparent from the following detailed description, which proceeds with reference to the accompanying drawings.

DETAILED DESCRIPTION OF THE PREFERRED EMBODIMENT

The current control apparatus according to the invention is adopted for use on a high voltage actuated fluorescent lamp to maintain normal operation of the current in the fluorescent lamp (CCFL) to avoid abnormal current occurred to the fluorescent lamp when actuated by a high voltage.

Figure 1:
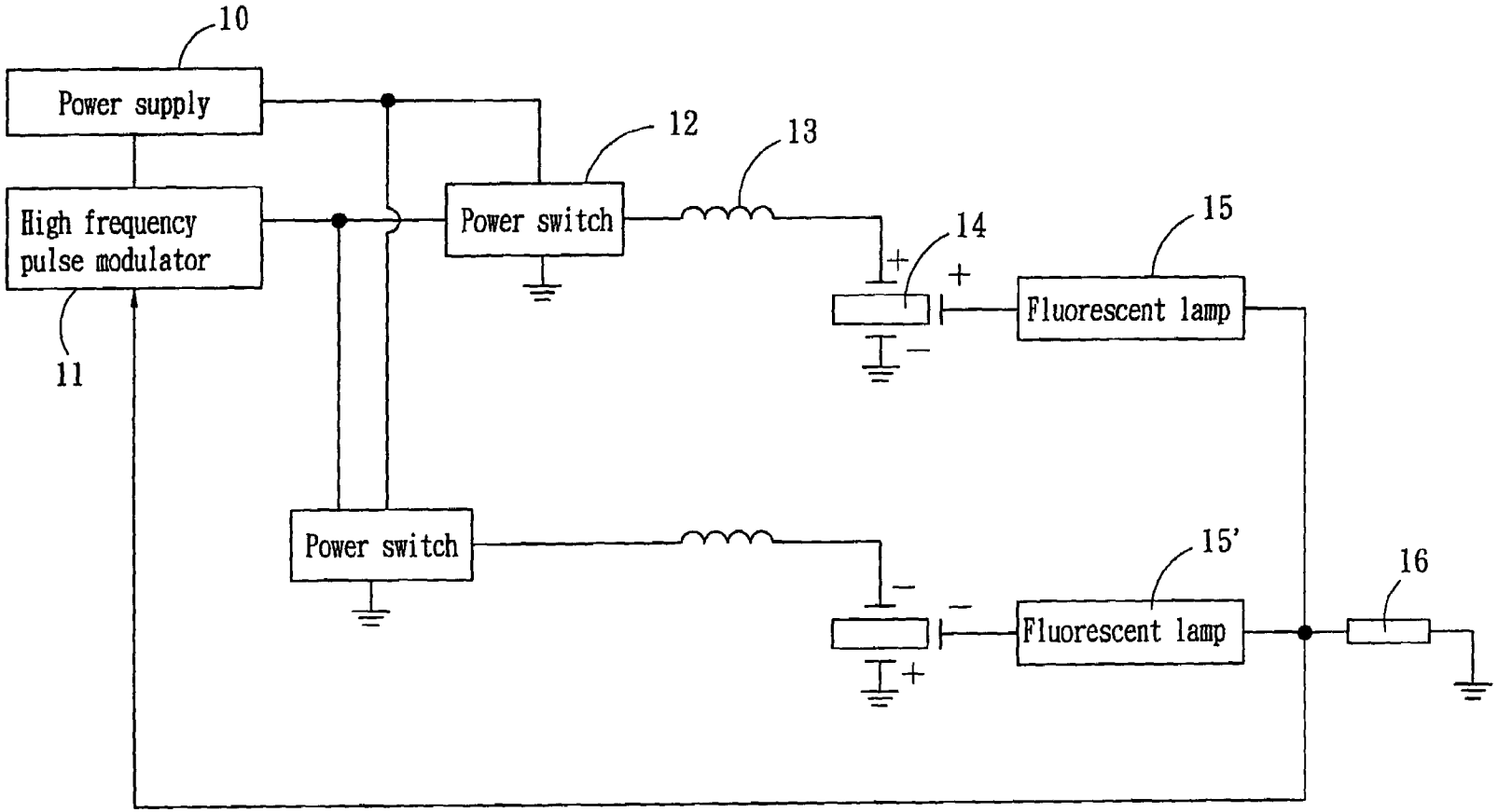
Fig. 1 PRIOR ART
FIG. 1 is a circuit diagram of a conventional current control circuit.
Figure 2:
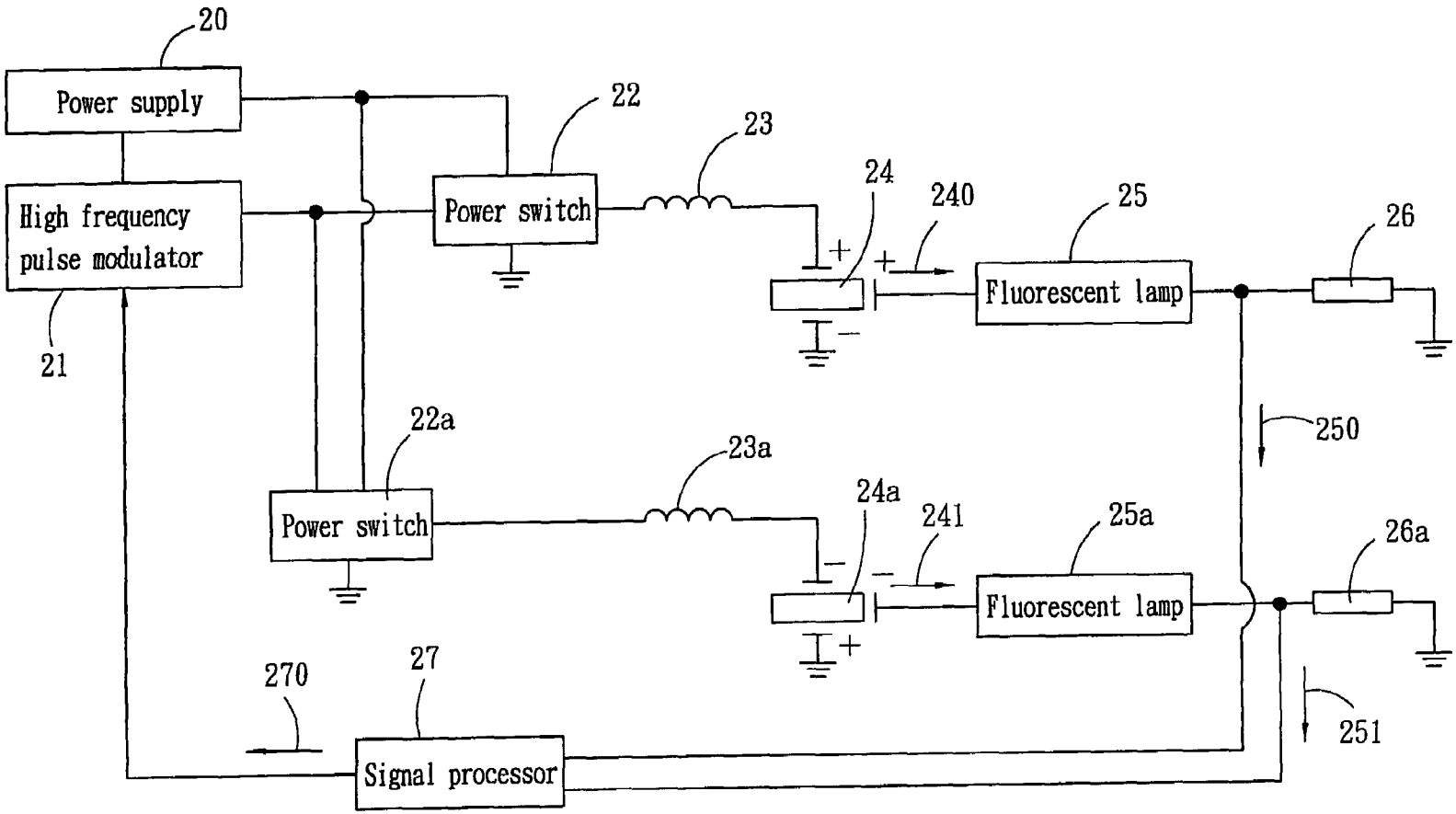
FIG. 2 is a circuit diagram the current control circuit of the invention.

Refer to FIG. 2 for a current control circuit diagram of the invention. It is for use on fluorescent lamps (as shown in the FIG. 2) 25 and 25*a* actuated by a high voltage to maintain evenness of the current in the fluorescent lamps 25 and 25*a*. It includes:

a high frequency pulse modulator 21 to receive operation voltage input from a power supply 20 and provide voltage distribution signals and transmit a pulse width modulation (PWM) resonant frequency signal through PWM;

a power switch (as shown in FIG. 2) 22 and 22*a* controlled by a positive half cycle signal and a negative half cycle signal of the PWM resonant frequency signal and outputs an actuation signal;

a conversion unit (as shown in FIG. 2) 23 and 23*a* that is an inductor to receive the voltage distribution signals and transform the voltage distribution signals and voltage;

a piezoelectric transformer(as shown in FIG. 2) 24 and 24*a* to receive the transformed voltage from the conversion unit 23 and 23*a*, and perform voltage transformation; and a fluorescent lamp(as shown in FIG. 2) 25 and 25*a* that is a CCFL connecting to the piezoelectric transformer 24 and 24*a*, and has two output ends connecting respectively to a resistor (as shown in FIG. 2) 26 and 26*a*, then are grounded.

Figure 3:
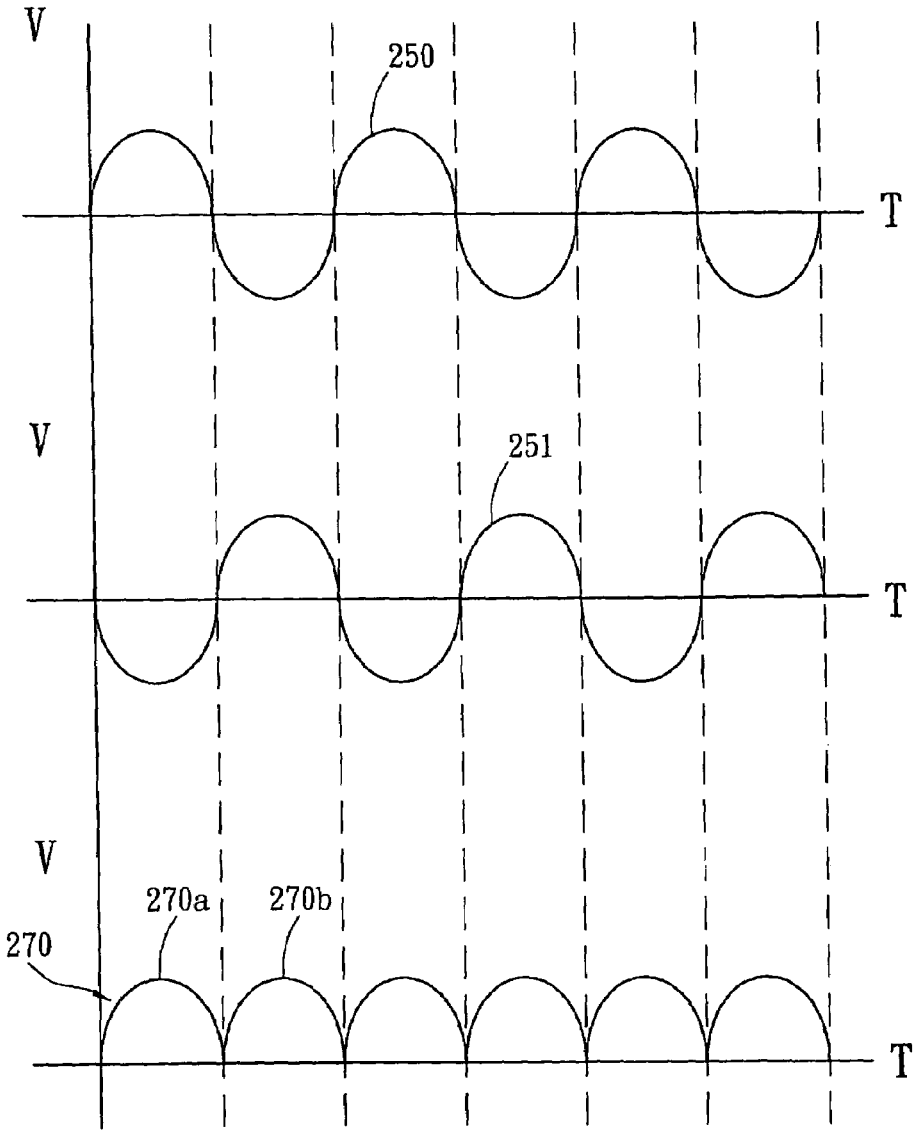
FIG. 3 is a schematic view of current waveforms of the invention.

Refer to FIG. 3 for the current signal waveforms of the invention. The invention has the following features: the fluorescent lamps 25 and 25*a* are divided into a positive phase fluorescent lamp 25 and an inverted phase fluorescent lamp 25*a*; the positive phase fluorescent lamp 25 is actuated by a positive half cycle actuation signal 240 sent from the power switch 22 and outputs a first current signal 250, while the negative phase fluorescent lamp 25*a* is actuated by a negative half cycle actuation signal 241 sent from the power switch 22*a* and outputs a second current signal 251. When the first current signal 250 is at the positive half cycle, the second current signal 251 is at the negative half cycle (referring to FIG. 3). A signal processor 27 processes the first current signal 250 at the positive half cycle and generates a current compensation signal 270*a* to the high frequency pulse modulator 21 which then outputs a resonant frequency to control the current variation of the fluorescent lamps 25 and 25*a*. On the contrary, when the first current signal 250 is at the negative half cycle, the second current signal 251 is at the positive half cycle (referring to FIG. 3). The signal processor 27 processes the second current signal 251 at the positive half cycle and generates another current compensation signal 270*b* to the high frequency pulse modulator 21 which then outputs a resonant frequency to control the current variation of the fluorescent lamps 25 and 25*a*. The first current signal 250 and the second current signal 251 have a phase difference of 180°. The signal processor 27 is a differential rectification circuit or a full-wave rectification circuit to rectify the first current signal 250 and the second current signal 251 in a full-wave fashion to generate the current compensation signal 270 (as shown in FIG. 3). The high frequency pulse modulator 21 determines and outputs the resonant frequency to even the current in the fluorescent lamps 25 and 25*a* to prevent abnormal current from occurring and causing power loss or damaging of the fluorescent lamps 25 and 25*a*.

What is claimed is:

1. A current control apparatus for fluorescent lamps adopted for used on a fluorescent lamp actuated by a high voltage to maintain an even current in the fluorescent lamps comprising a high frequency pulse modulator to obtain a feedback signal from a signal processor to output a pulse width modulation (PWM) resonant frequency signal to modulate a power switch to output an actuation signal which is transformed by a conversion unit to actuate a piezoelectric transformer, wherein:

the fluorescent lamp is divided to a positive phase fluorescent lamp and an inverted phase fluorescent lamp, the positive phase fluorescent lamp outputting a first current signal and the negative phase fluorescent lamp outputting a second current signal, the first current signal being at the positive half cycle while the second current signal being at the negative half cycle, the signal processor processing the first current signal at the positive half cycle and generating a current compensation signal to the high frequency pulse modulator which outputs a resonant frequency to control current variation of the fluorescent lamp; the first current signal being at the negative half cycle while the second current signal being at the positive half cycle, and the signal processor processing the second current signal at the positive half cycle and generating another current compensation signal to the high frequency pulse modulator which outputs another resonant frequency to control the current variation of the fluorescent lamps.

2. The current control apparatus of claim 1, wherein the fluorescent lamp is a cold cathode fluorescent lamp.

3. The current control apparatus of claim 1, wherein the conversion unit is an inductor.

4. The current control apparatus of claim 1, wherein the signal processor is a differential rectification circuit.

5. The current control apparatus of claim 1, wherein the signal processor is full-wave rectification circuit.

6. The current control apparatus of claim 1, wherein the current compensation signal is a full-wave rectification signal.

7. The current control apparatus of claim 1, wherein the positive half cycle and the negative half cycle have a phase angle difference of 180 degrees.

* * * * *